US012686515B2

(12) United States Patent
Rogers

(10) Patent No.: US 12,686,515 B2
(45) **Date of Patent: *Jul. 21, 2026**

(54) ZERO VENT POUCH FILLER

(71) Applicant: BBC Packaging, LLC, Hudson, WI (US)

(72) Inventor: William D. Rogers, Shakopee, MN (US)

(73) Assignee: BBC Packaging, LLC, Huson, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/911,918

(22) Filed: Oct. 10, 2024

(65) Prior Publication Data

US 2025/0033816 A1 Jan. 30, 2025

Related U.S. Application Data

(63) Continuation of application No. 17/746,004, filed on May 17, 2022, now Pat. No. 12,139,286.

(60) Provisional application No. 63/189,537, filed on May 17, 2021.

(51) Int. Cl.

| | |
|---|---|
| ***B65B 39/10*** | (2006.01) |
| ***B65B 43/12*** | (2006.01) |
| ***B65B 43/30*** | (2006.01) |
| ***B65B 43/46*** | (2006.01) |
| ***B65B 61/18*** | (2006.01) |

(52) U.S. Cl.

CPC ..... *B65B 39/10* (2013.01); *B65B 43/12* (2013.01); *B65B 43/30* (2013.01); *B65B 43/465* (2013.01); *B65B 61/186* (2013.01)

(58) Field of Classification Search

CPC .. B65B 1/04; B65B 3/04; B65B 39/08; B65B 39/10; B65B 43/12; B65B 43/30; B65B 43/465; B65B 61/186

See application file for complete search history.

(56) References Cited

U.S. PATENT DOCUMENTS

| | | | | |
|---|---|---|---|---|
| 3,708,952 | A * | 1/1973 | Schulze | B65B 31/041 53/512 |
| 3,949,536 | A * | 4/1976 | Chevalier | B65B 7/06 141/114 |
| 4,033,093 | A * | 7/1977 | Mencacci | B65B 31/04 141/264 |
| 5,113,917 | A * | 5/1992 | McGregor | B65B 37/00 222/196 |
| 5,535,792 | A * | 7/1996 | McGregor | B65B 43/465 53/527 |
| 5,687,551 | A * | 11/1997 | Mustain | B65B 43/60 141/10 |
| 6,655,114 | B2 * | 12/2003 | Hiramoto | B29C 66/8181 53/53 |

(Continued)

*Primary Examiner* — Nicolas A Arnett

(74) *Attorney, Agent, or Firm* — David M. Breiner; BrownWinick Law Firm

(57) ABSTRACT

Example embodiments relate to a system for filling a stand-up pouch. The system includes a pouch fill injector having a pouch fill spout, a seal jaw assembly having a first jaw and second jaw with receiving areas to interface with the pouch fill tube, and a pouch opening device to open an end of a pouch. Unlike prior art systems, the system of example embodiments does not require a vacuum assist to fill a stand-up pouch.

20 Claims, 18 Drawing Sheets

(56) References Cited

U.S. PATENT DOCUMENTS

| | | | | |
|---|---|---|---|---|
| 6,931,824 | B2 * | 8/2005 | Rogers | B65B 3/32 53/389.1 |
| 8,707,663 | B2 * | 4/2014 | Matheyka | B65B 59/04 141/86 |
| 9,114,898 | B2 * | 8/2015 | Wehling | B65B 51/225 |
| 9,505,504 | B2 * | 11/2016 | Murray | B65B 43/465 |
| 10,053,255 | B2 * | 8/2018 | Murray | B31B 70/844 |
| 10,421,620 | B2 * | 9/2019 | Bianchi | B65B 43/50 |
| 10,501,222 | B2 * | 12/2019 | Nakamoto | B65G 21/12 |
| 10,583,623 | B2 * | 3/2020 | Smith | B65B 61/186 |
| 12,139,286 | B2 * | 11/2024 | Rogers | B65B 43/30 |
| 2003/0233812 | A1 * | 12/2003 | Rogers | B65B 61/186 53/469 |
| 2007/0289261 | A1 * | 12/2007 | Rogers | B65B 43/465 53/467 |
| 2010/0006175 | A1 * | 1/2010 | Shinagawa | B65B 3/22 141/7 |
| 2012/0008884 | A1 * | 1/2012 | Murray | B65D 75/5805 383/104 |
| 2012/0240531 | A1 * | 9/2012 | Kawamura | B65B 31/044 53/572 |
| 2014/0352259 | A1 * | 12/2014 | Murray | B65B 61/186 53/433 |
| 2019/0023479 | A1 * | 1/2019 | Sade | A23L 5/10 |

* cited by examiner

ZERO VENT POUCH FILLER

CROSS-REFERENCE TO RELATED APPLICATION

This application is a continuation of U.S. patent application Ser. No. 17/746,004 which was filed with the United States Patent and Trademark Office on May 17, 2022 which in turn claims the benefit of U.S. Provisional Patent Application No. 63/189,537 which was filed with the United States Patent and Trademark Office on May 17, 2021, the entire contents of each is herein incorporated by reference.

BACKGROUND

1. Field

Example embodiments relate to a system configured to fill a stand-up pouch and methods for filling a stand-up pouch.

2. Description of the Related Art

Stand-up pouches are used as packages for various types of items, for example, food, medication, water and juice. Generally speaking, stand-up pouches are received at a filling station in a substantially collapsed state (e.g. a flat unopened condition) where an end of the pouch is opened followed by an air blast to further open the pouch prior to receiving a liquid. Air blasts, however, are potential sources of contamination. Furthermore, filling of the opened pouch is most often done with the pouch open. This fill must be controlled to prevent air venting from the pouch carrying liquid out with the vented air. This limits the fill speed and is a potential contamination source for contents vented to the surrounding environment.

SUMMARY

To address the problem of venting, the inventor created a filling system which does vent air during pouch filling (Zero Vent Pouch Filler); does not require vacuum to evacuate the pouch before filling; and does not require a blast of air as a step in filling a stand-up pouch. As a result, the inventor invented a novel and nonobvious system for filling stand-up pouches having a reduced tendency towards contamination improves filing speed, and is environmentally friendly.

In accordance with example embodiments, a system may include a pouch fill injector having a pouch fill spout, a seal jaw assembly having a first jaw and second jaw with receiving areas to interface with the pouch fill spout, and a pouch opening device to open an end of a pouch.

In accordance with example embodiments, a method of manufacturing a stand-up pouch may include securing a stand-up pouch in a clamp conveyor, moving the stand-up pouch to a system having a movable pouch fill spout, a moveable seal jaw assembly, and a moveable pouch opening device, opening a top end of the stand-up pouch using the moveable pouch opening device while the stand-up pouch is in motion, inserting the movable pouch fill spout into the stand-up pouch while the stand-up pouch is moving, clamping the top end of the stand-up pouch to the pouch fill spout using the moveable seal jaw assembly while the stand-up pouch is moving, filling the stand-up pouch while the pouch is moving, while the pouch fill spout is inserted into the stand-up pouch, and while the top end of the stand-up pouch is clamped, unclamping the stand-up pouch, withdrawing the pouch fill spout, and inserting a fitment into the stand-up pouch after the pouch fill tube is withdrawn from the stand-up pouch.

BRIEF DESCRIPTION OF THE DRAWINGS

Example embodiments are described in detail below with reference to the attached drawing figures, wherein.

DETAILED DESCRIPTION

Figure 1:
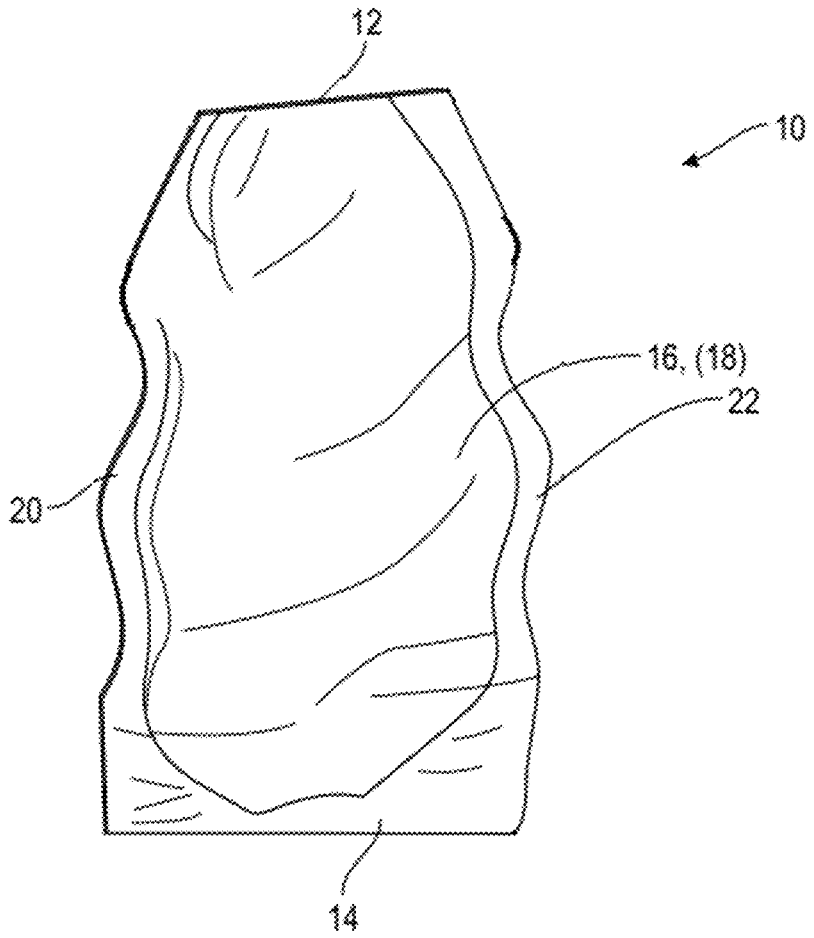
FIG. 1 is a view of a conventional stand-up pouch.

Example embodiments will now be described more fully with reference to the accompanying drawings, in which example embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on," "connected to," or "coupled to" another element or layer, it can be directly on, connected to, or coupled to the other element or layer or intervening elements or layers that may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another elements, component, region, layer, and/or section. Thus, a first element component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to system and method for filling a stand-up pouch.

FIG. 1 is a view of a stand-up pouch 10 usable with example embodiments. As shown in FIG. 1, the stand-up pouch 10 includes an open top 12, a closed bottom 14, and two side walls 16 and 18, which generally face each other (in FIG. 1, the symbol (18) indicates the side wall 18 is not directly shown in the figure but is understood to be on the side of the stand-up pouch 10 not shown). The side walls 16 and 18 come together to form edges 20 and 22. The stand-up pouch 10 is generally flexible and may be configured to stand erect on its bottom 14 when filled or inflated, though it's not required the bottom be configured that way. The stand-up pouch 10 may be made from many materials including, but not limited to, plastic. The stand-up pouch 10 may be constructed of multi-layer materials, for example, various plastic films, paper, foil, etc., as is well known in the art. One skilled in the art would understand the stand-up pouch 10 is configured to receive food, medicine and/or drink items such as, but not limited to, pastes (for example, peanut butter and or cheese), insulin, juice, and water. Thus, one skilled in the art would understand stand-up pouch 10 to have a receiving space between the side walls 16,18, the closed bottom 14, and the open top 12 and that the food, medicine, and/or drink items may enter the space through the open top 12.

Generally speaking, the stand-up pouches 10 are received from a pouch maker in a substantially flat and collapsed condition. As explained in the background section, prior art filling systems generally blast air into the stand-up pouch 10 by opening the top 12 and blasting air therein. Blasting air inflates the stand-up pouch 10 allows the pouch to easily receive items such as, but not limited to, liquids, food items, medicines, etc. Of course, air blasting is a potential source of contamination. In example embodiments a method of filling stand-up pouch 10 does not require using air blasts to open the stand-up pouch 10 prior to filling. When opened, a typical prior art stand-up pouch will vent the air from the fill space during the filling operation. This system, however, fills the stand-up pouch 10 when the open mouth 12 of the pouch 10 is clamped shut and the fill liquid itself inflates the pouch rather than an air blast. This is done without requiring that the stand-up pouch be subjected to a vacuum prior to filling. Rather, in example embodiments, the stand-up pouch 10 remains in a substantially collapsed condition during filling thus avoiding a potential contamination from an air blast. For example, more than half of the stand-up pouch 10 may be in a substantially collapsed condition when the stand-up pouch 10 is initially being filled. It is understood the stand-up pouch 10 of FIG. 1 is for illustrative purposes only and is not intended to limit the invention as the stand-up pouch 10 may be configured in any number of ways.

Figure 2:
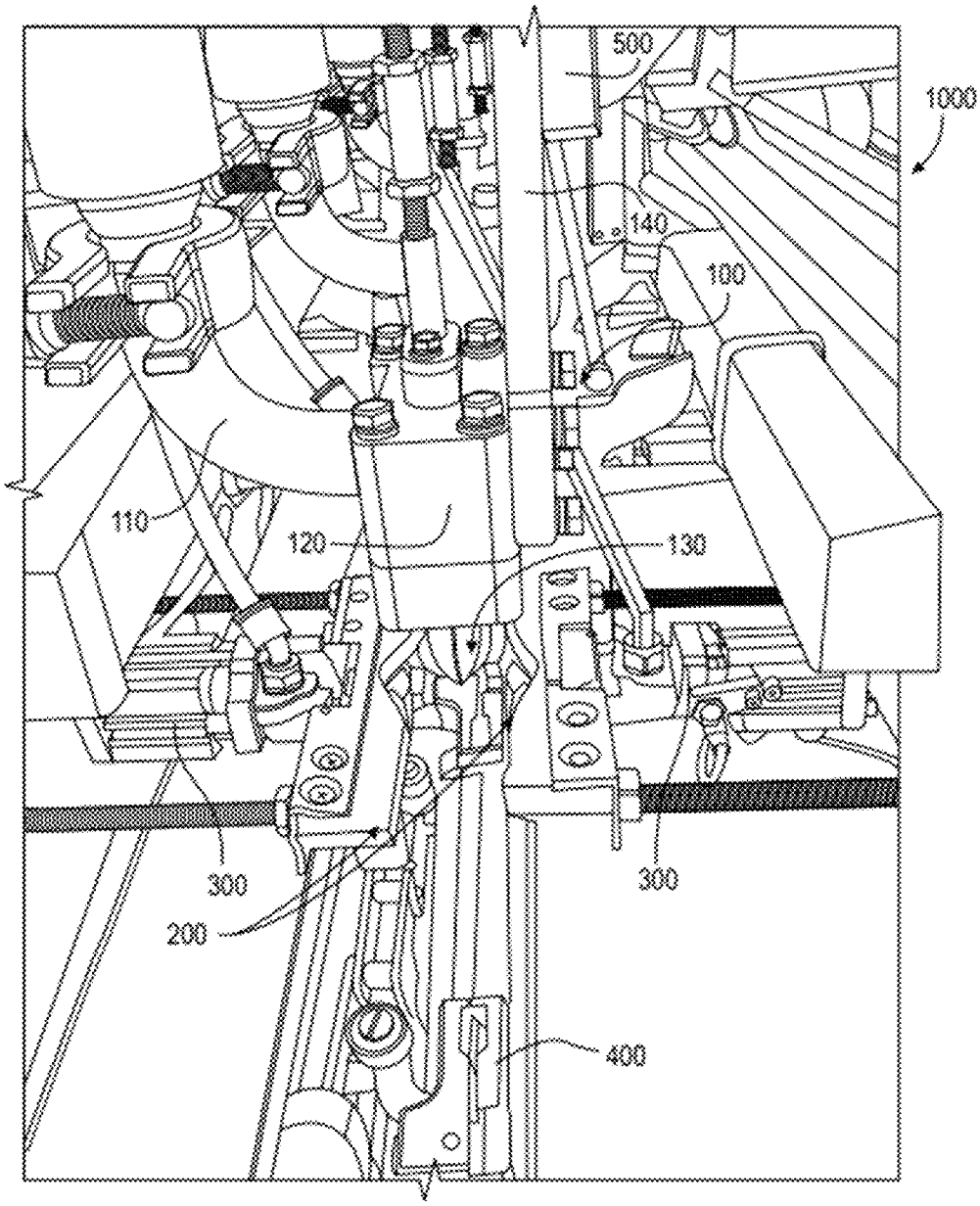
FIG. 2 is a view of a system in accordance with example embodiments.

FIG. 2 is a first perspective view of a portion of a stand-up pouch filling system 1000. In example embodiments the stand-up pouch filling system 1000 includes a pouch fill injector 100, a seal jaw assembly 200, and a stand-up pouch opening device 300. As will be explained shortly, the stand-up pouch filling system 1000 may include additional elements such as a stand-up pouch clamp conveyor 400 which allows the stand-up pouch filling system 1000 to operate as a continuous filling system.

In example embodiments, the pouch fill injector 100 may be configured to receive and inject a liquid into a stand-up pouch 10. To that end, the pouch fill injector 100 may include a receiving tube 110 for receiving a liquid, a passthrough manifold 120 for receiving the liquid from the receiving tube 110, and a pouch fill spout 130 configured to receive the liquid from the passthrough manifold 120 and to inject the liquid into the stand-up pouch 10. More specifically, the pouch fill spout 130 includes a passageway therethrough through which the liquid may pass. The pouch fill spout 130 may also be configured to insert into the open top 12 of the stand-up pouch 10.

In one nonlimiting example embodiment, the pouch fill spout 130 may be removably attached to the pass through manifold 120. This allows different pouch fill spouts 130 having different configurations to attach to the pass through manifold 120. An advantage of this embodiment is that the system 1000 would have increased flexibility as different size pouch fill spout 130 may be used to accommodate different size and shaped stand-up pouches.

In example embodiments the pouch fill injector 100 of system 1000 may be configured to move vertically and horizontally. The vertical movement of the pouch fill injector 100 allows the pouch fill spout 130 to move downward and into the open top 12 of the stand-up pouch 10 as well as upward to draw the pouch fill spout 130 out of the stand-up pouch 10. For example, the pouch fill injector 100 may include a connecting bar 140 which connects the pass through manifold 120 to a carriage 500 that may be configured to move up and down. As the carriage 500 moves up and down the pouch fill injector 100 would likewise move up and down. Furthermore, moving the carriage 500 horizontally would likewise move the pouch fill injector 100 horizontally. Configuring the system 1000 so that the pouch fill injector 100 moves horizontally allows the pouch fill injector 100 to move along with the stand-up pouch 10 that may be moved by the stand-up pouch clamp conveyor 400 so that the stand-up pouch 10 may be filled while it is being moved.

Figure 3:
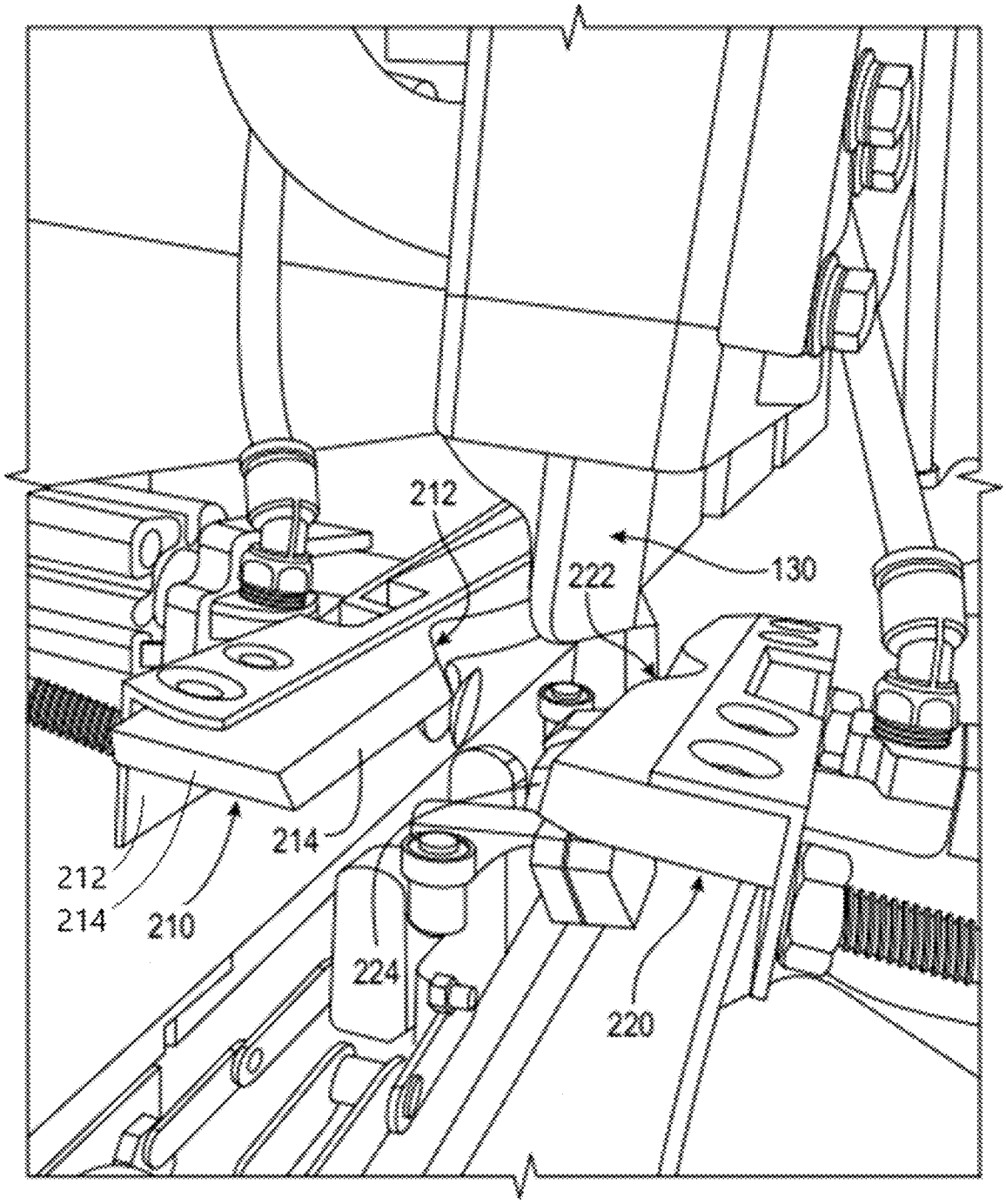
FIG. 3 is a view of a system in accordance with example embodiments.
Figure 4:
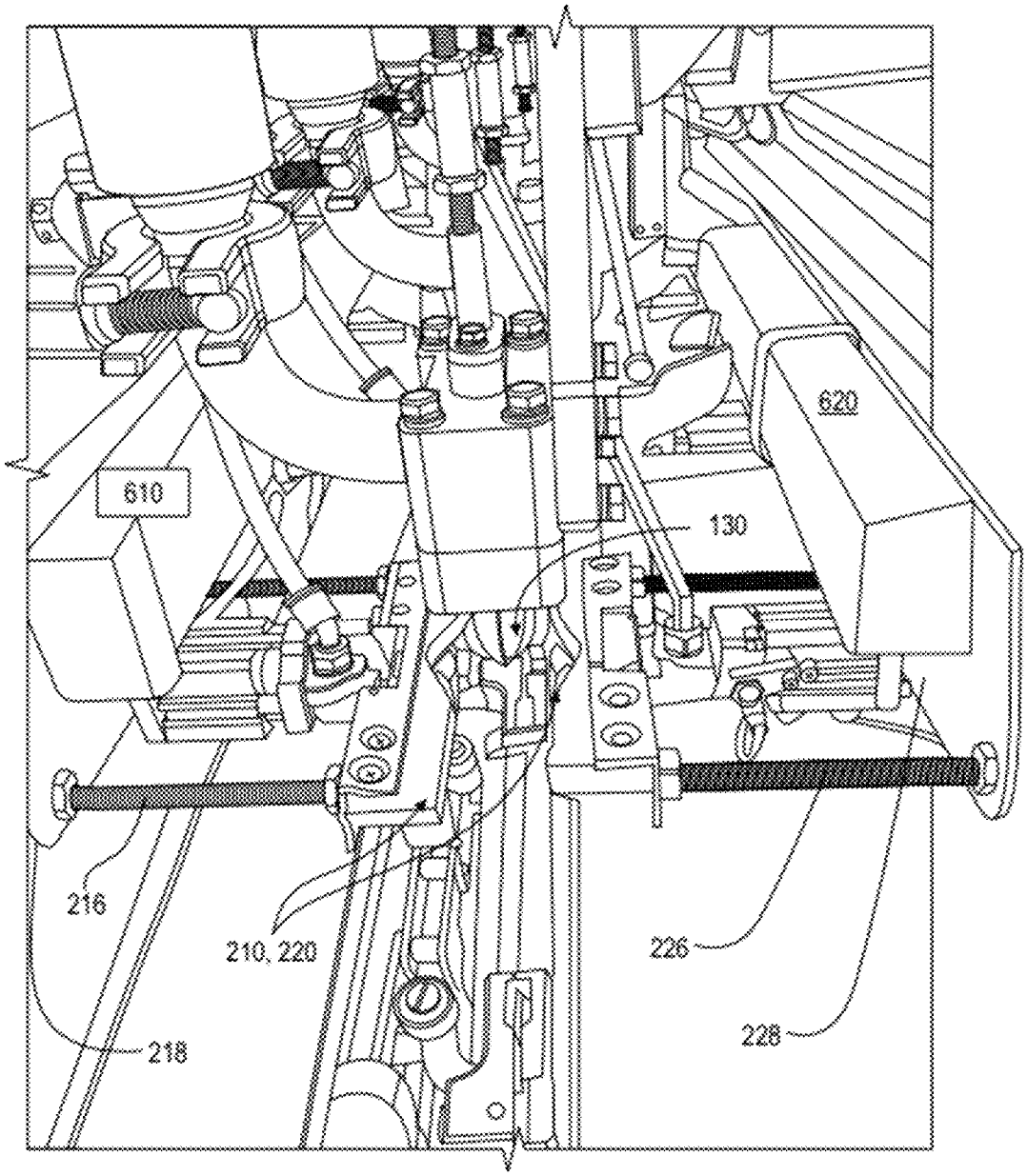
FIG. 4 is a view of a system in accordance with example embodiments.

As shown in FIG. 3, the seal jaw assembly 200 may include a first jaw 210 and a second jaw 220. The first jaw 210 may include a receiving area 212 for receiving a first side of the pouch fill spout 130 and the second jaw 220 may include a receiving area 222 for receiving a second side of the pouch fill spout 130. In example embodiments the first and second jaws 210 and 220 are movably supported and can move towards and away from each other. In the nonlimiting example embodiment presented herein, for example, the first jaw 210 may be supported by a moveable carriage 610 which may be configured to move horizontally (see FIG. 4). For example, as shown in FIG. 4, the first jaw 210 may be connected to the moveable carriage 610 by a pair of struts 216 which may connect to a plate 218 connected to the moveable carriage 610. Similarly, the second jaw 220 may be connected to a second carriage 620 which may also be configured to move horizontally. The second jaw 220, for example, may be connected to the moveable carriage 620 by a pair of struts 226 which may connect to a plate 228 connected to the second carriage 620. Thus, as the moveable carriages 610 and 620 move towards or away from one another, the first and second jaws 210 and 220 move towards or away from one another.

Figure 5:
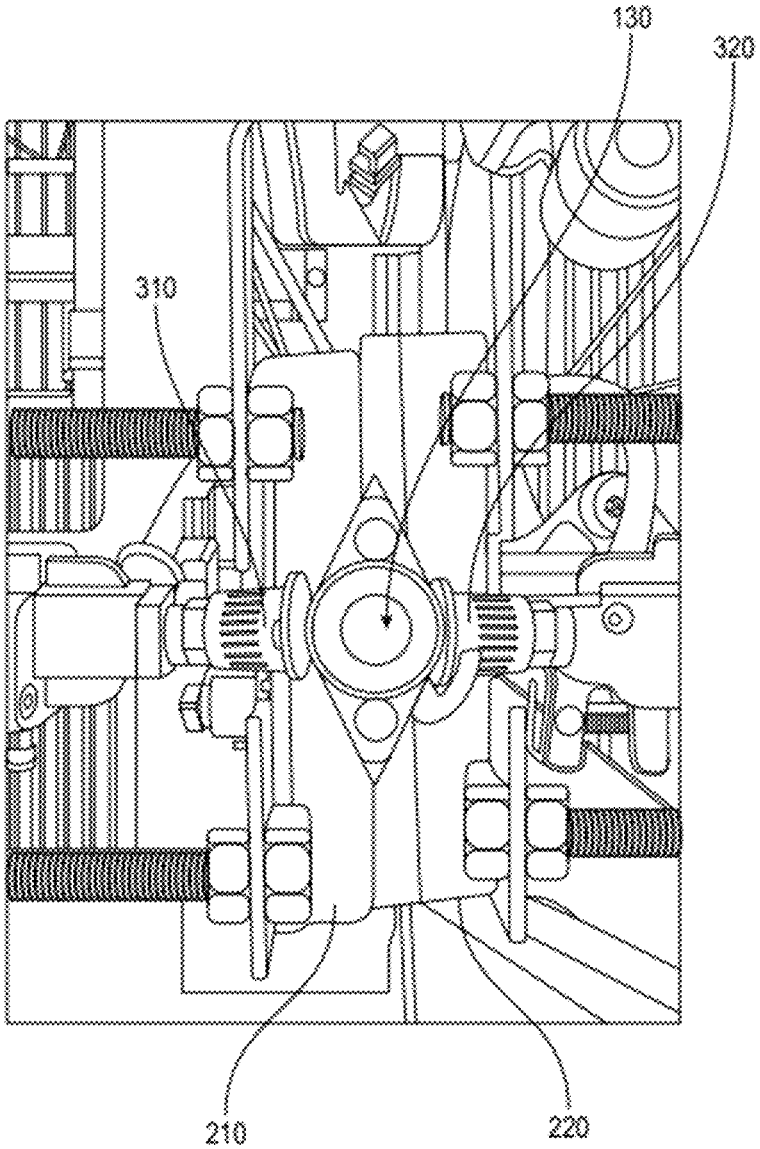
FIG. 5 is a view of a system in accordance with example embodiments.
Figure 18:
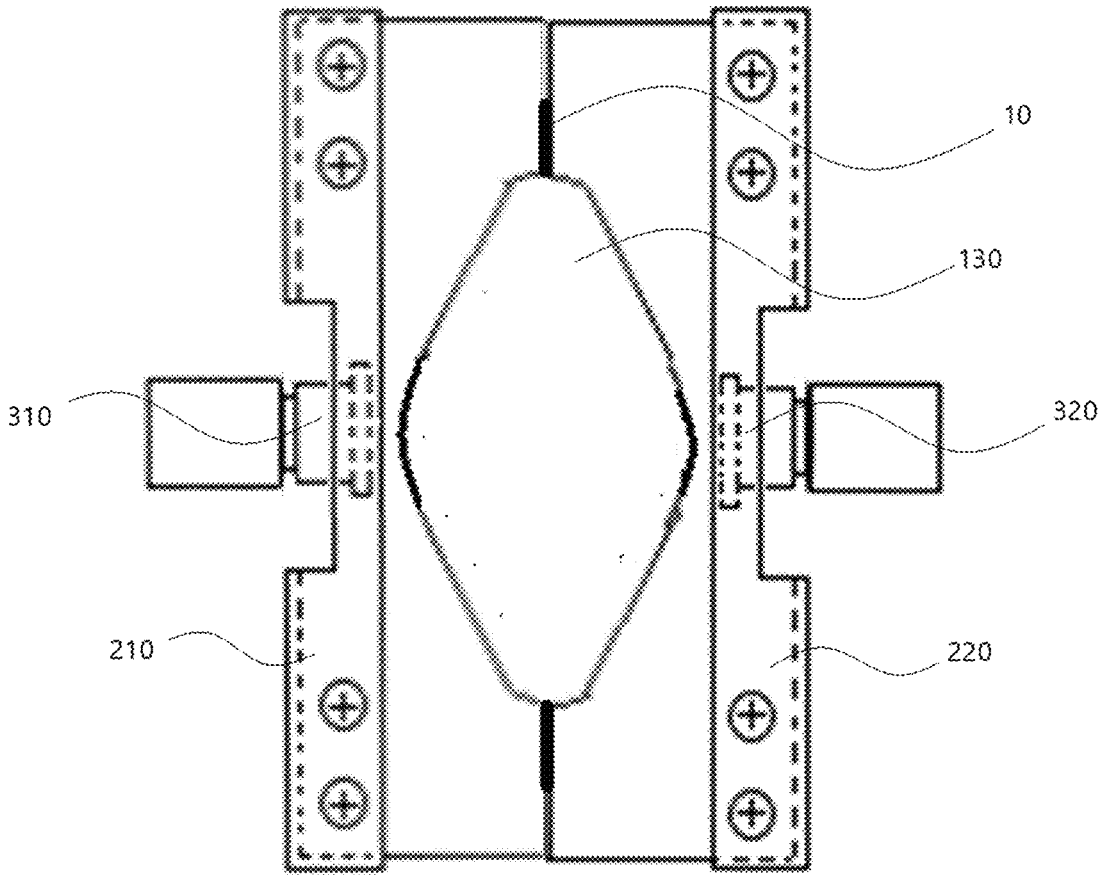
FIG. 18 is another partial view of a system in accordance with example embodiments.

In example embodiments, when the first and second jaws 210 and 220 are moved together the combined receiving areas 212 and 222 have an area that substantially conforms to a cross-sectional area of the pouch fill spout 130 as shown in FIG. 5 (and also FIG. 18). As will be explained shortly, this geometry is desirable to ensure a proper seal be formed for filling a stand-up pouch 10. In addition, the first and second jaws 210 and 220 have surfaces 214 and 224 that come together to seal an end of the stand-up pouch 10 when the stand-up pouch is being filled by the pouch fill spout 130.

In example embodiments, the pouch fill spout 130, as previously described, may come in different sizes and, in fact, may have different shapes. For example, and by way of example only, the pouch fill spout may have a circular cross-section. To accommodate the different size and shaped pouch fill spouts 130, the first and second jaws 210 may be configured with a replaceable pad that forms the receiving areas 212 and 222 for different sized fill spouts 130. For example, as shown in FIG. 3, the first jaw 210 may be comprised of a frame 212 (which may have, but is not required to have) an "L" shaped cross-section) and a removable pad 214 having the receiving area 212. The removable pad 214 may be attached to the frame 212 by attachment members such as, but not limited to, screws, clips, nuts, and bolts. Thus, if a fill spout 130 is replaced, a removable pad 214 may be replaced with another removable pad 214 having the necessary geometry to accommodate the new fill spout 130.

Figure 6:
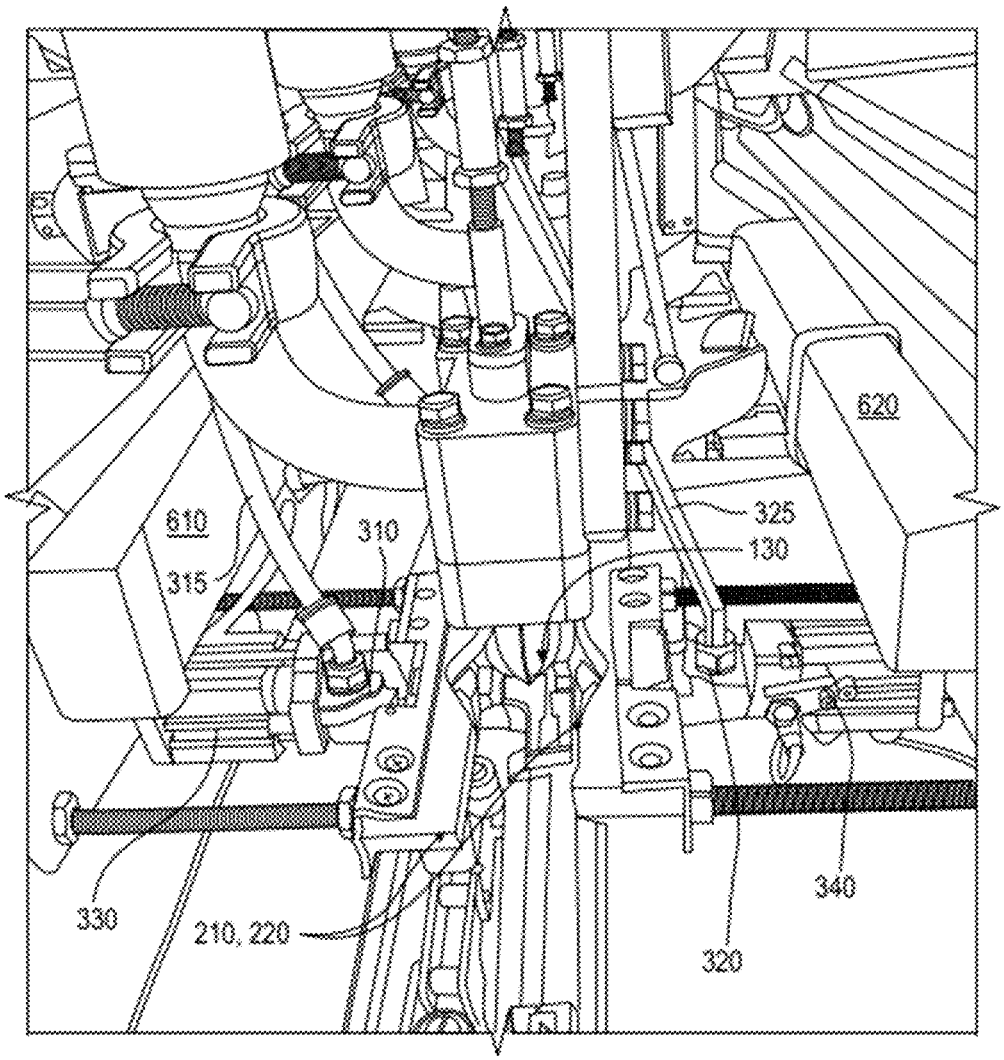
FIG. 6 is a view of a system in accordance with example embodiments.

In example embodiments, the operations for filling a stand-up pouch 10 include opening an end 12 of the stand-up pouch 10 for insertion of the pouch fill spout 130. To this end, the stand-up pouch opening device 300 is integrated into the system 1000. As shown in FIG. 6, the stand-up opening device 300 may, in one embodiment, resemble suction cups 310 and 320, which may be pneumatic suction cups, which may be operatively connected to first and second actuators 330 and 340 so that as the actuators operate the suction cups 310 and 320 may be moved towards a stand-up pouch 10. More specifically, the suction cups 310 and 320 may move towards the sidewalls 16 and 18 of the stand-up pouch 10 and attach to the sidewalls 16 and 18 of the stand-up pouch 10. The first and second actuators 330 and 340 may thereafter cause the suction cups 310 and 320 to move way from one another thus causing the sidewalls 16 and 18 to move apart from one another. For example, the first and second actuators 330 and 340 may be pneumatic cylinders and the first suction cup 310 may be attached to an end of a rod of the first actuator 330 and the second section cup 320 may be attached to an end of a rod of the second actuator 340. The strength of suction in the suction cups 310 and 320 may be controlled by controlling air flowing into or out of the suction cups 310 and 320 by pneumatic lines 315 and 325. It is understood the invention is not limited to an opening device 300 using suctions cups, for example, the stand-up pouch opening device 300 may resemble posts having a sticky substance at an end thereof to weakly adhere ends of the posts to the a stand-up pouch 10 so that as the posts are drawn away from the a stand-up pouch 10 the end of the a stand-up pouch 10 opens.

In example embodiments, the first and second actuators 330 and 340 may be connected to the moveable carriages 610 and 620, respectively. Thus, as the moveable carriages 610 and 620 move towards one another the first and second actuators 330 and 340 move towards one another. As the actuators 330 and 340 are actuated, the rods of the actuators 330 and 340 may cause the suctions cups 310 and 320 to move towards each other to attach to opposing sides 16 and 18 of a stand-up pouch 10. The actuators 330 and 340 may thereafter be controlled to move the suction cups 310 and 320 away to cause the opposing sides 16 and 18 to move away from one another. For example, the actuators 330 and 340 may be retracted to move the suctions cups 310 and 320 away from each other. This action may cause a top 12 of a stand-up pouch 10 to open slightly allowing the pouch fill spout 130 to insert into the end of the stand-up pouch 10.

Figure 7:
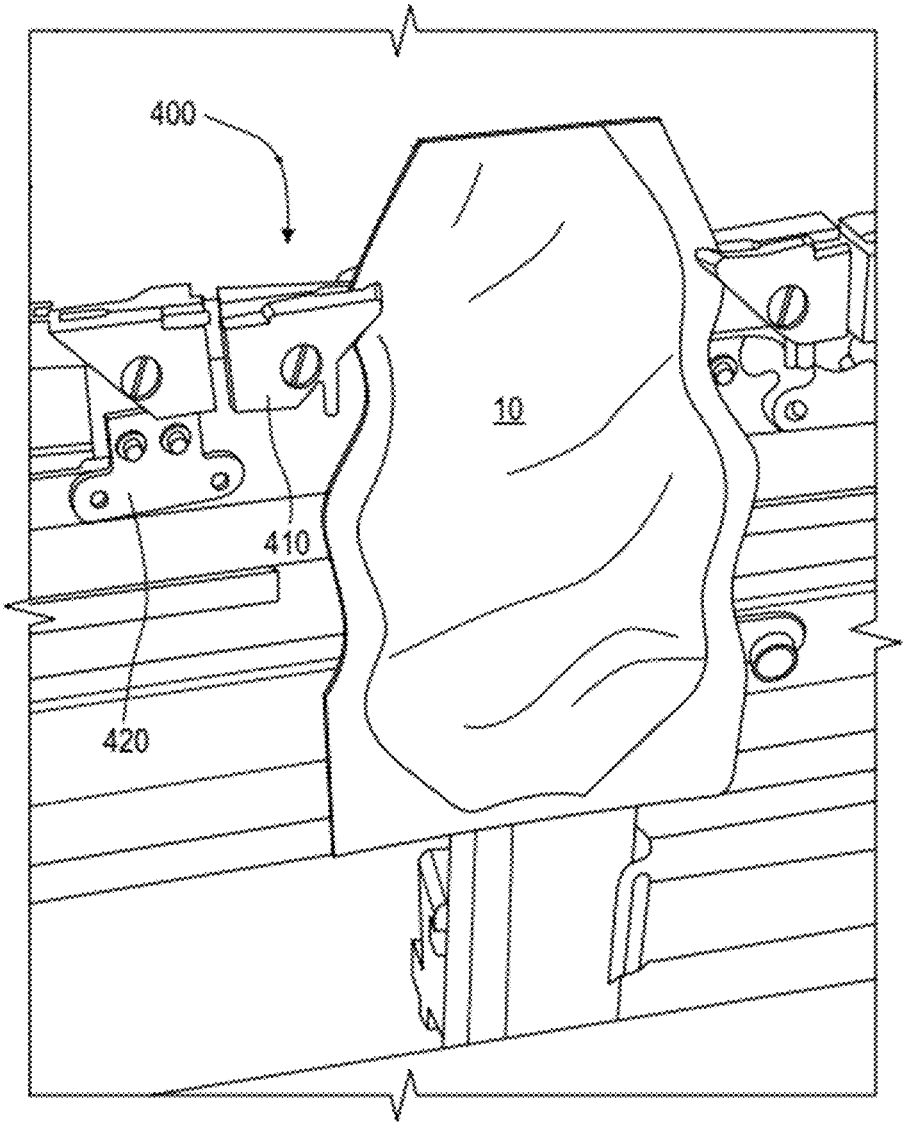
FIG. 7 is a view of a system and a method step in accordance with example embodiments.
Figure 8:
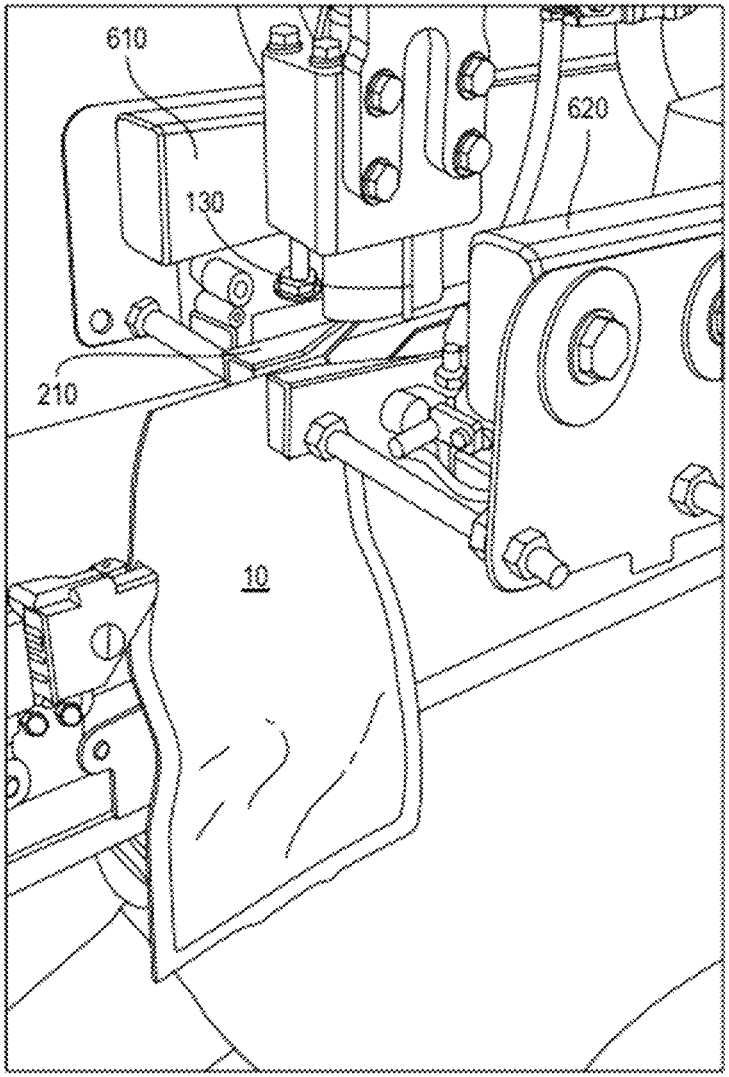
FIG. 8 is a view of a system and a method step in accordance with example embodiments.
Figure 9:
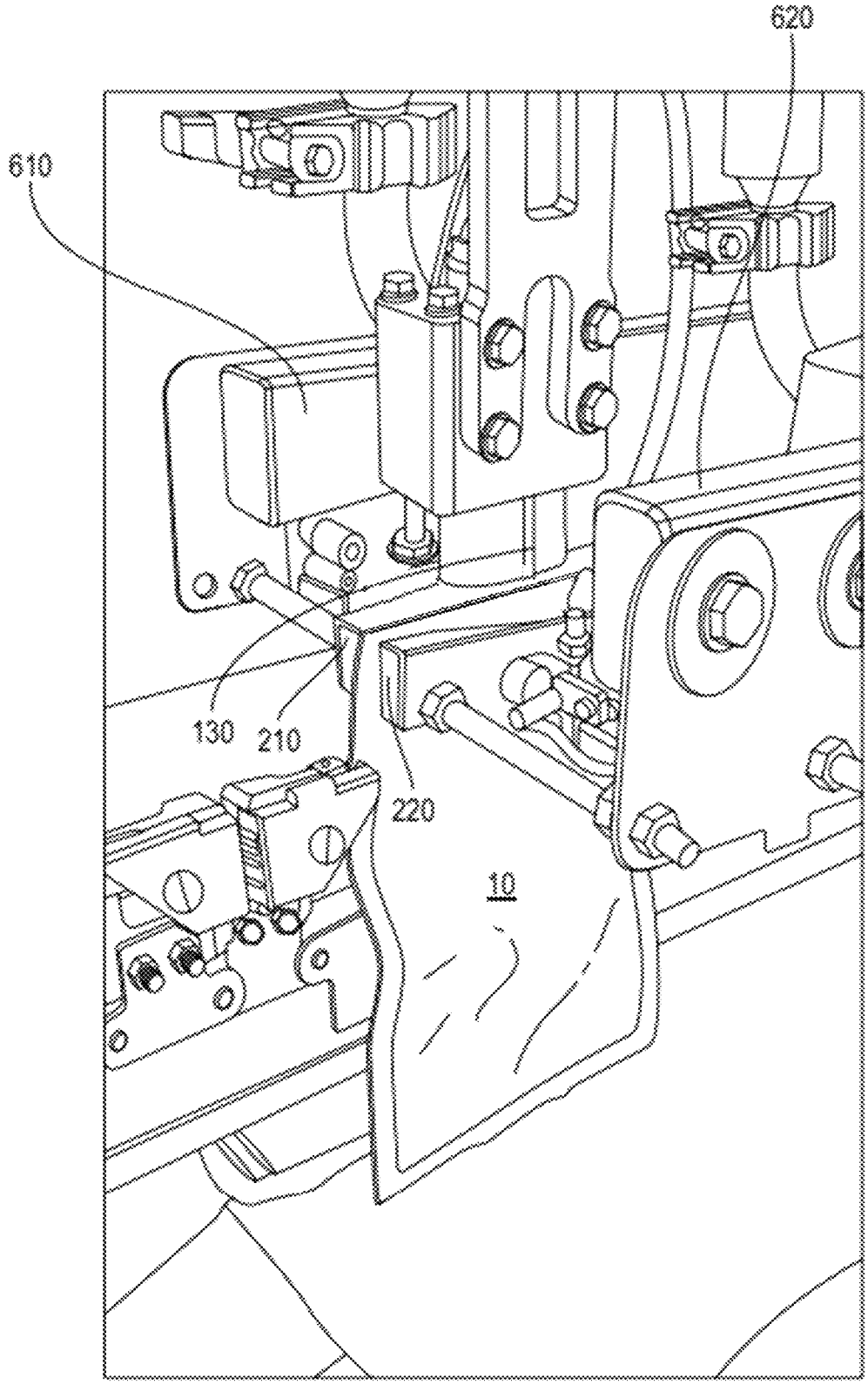
FIG. 9 is a view of a system and a method step in accordance with example embodiments.
Figure 10:
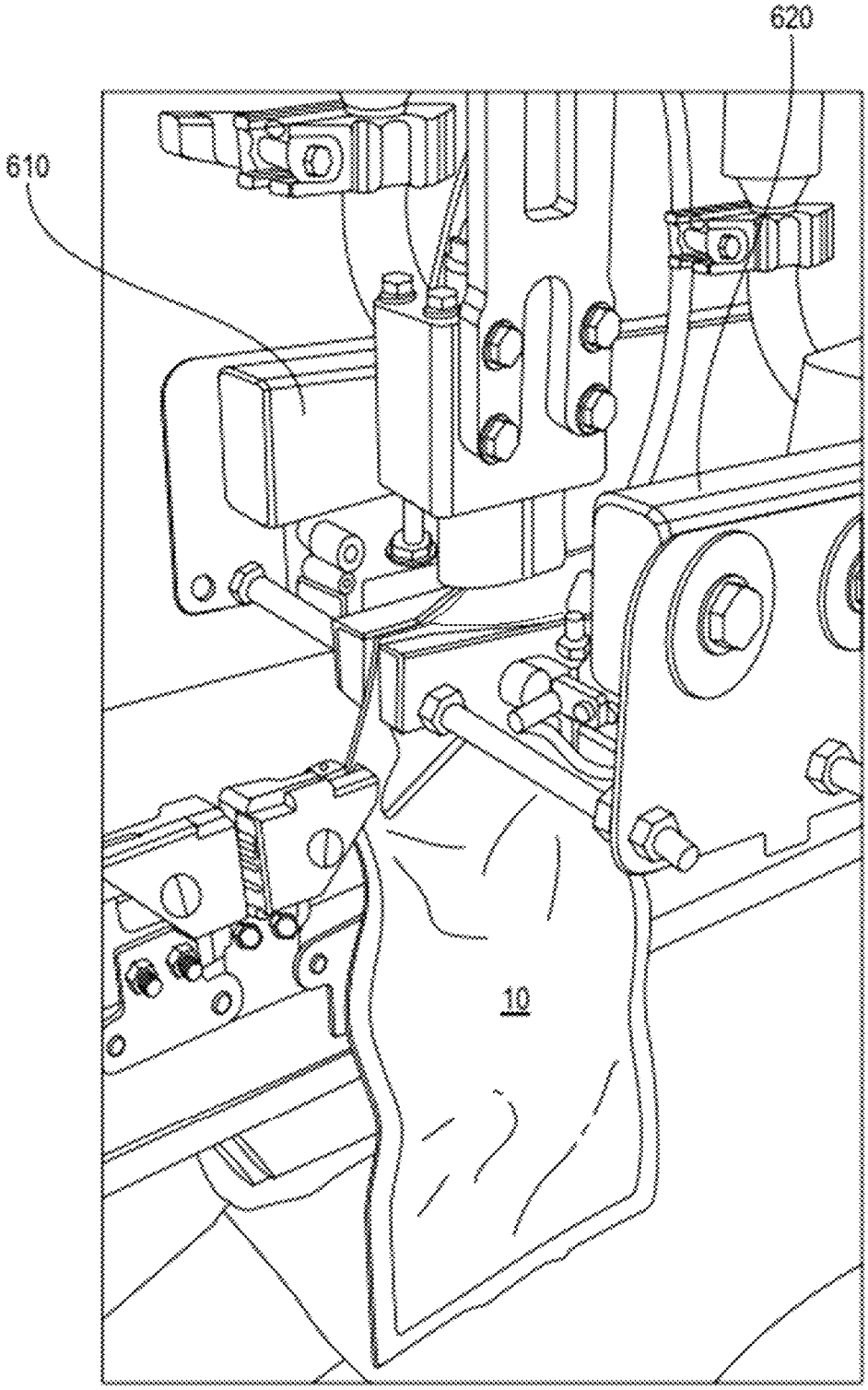
FIG. 10 is a view of a system and a method step in accordance with example embodiments.
Figure 11:
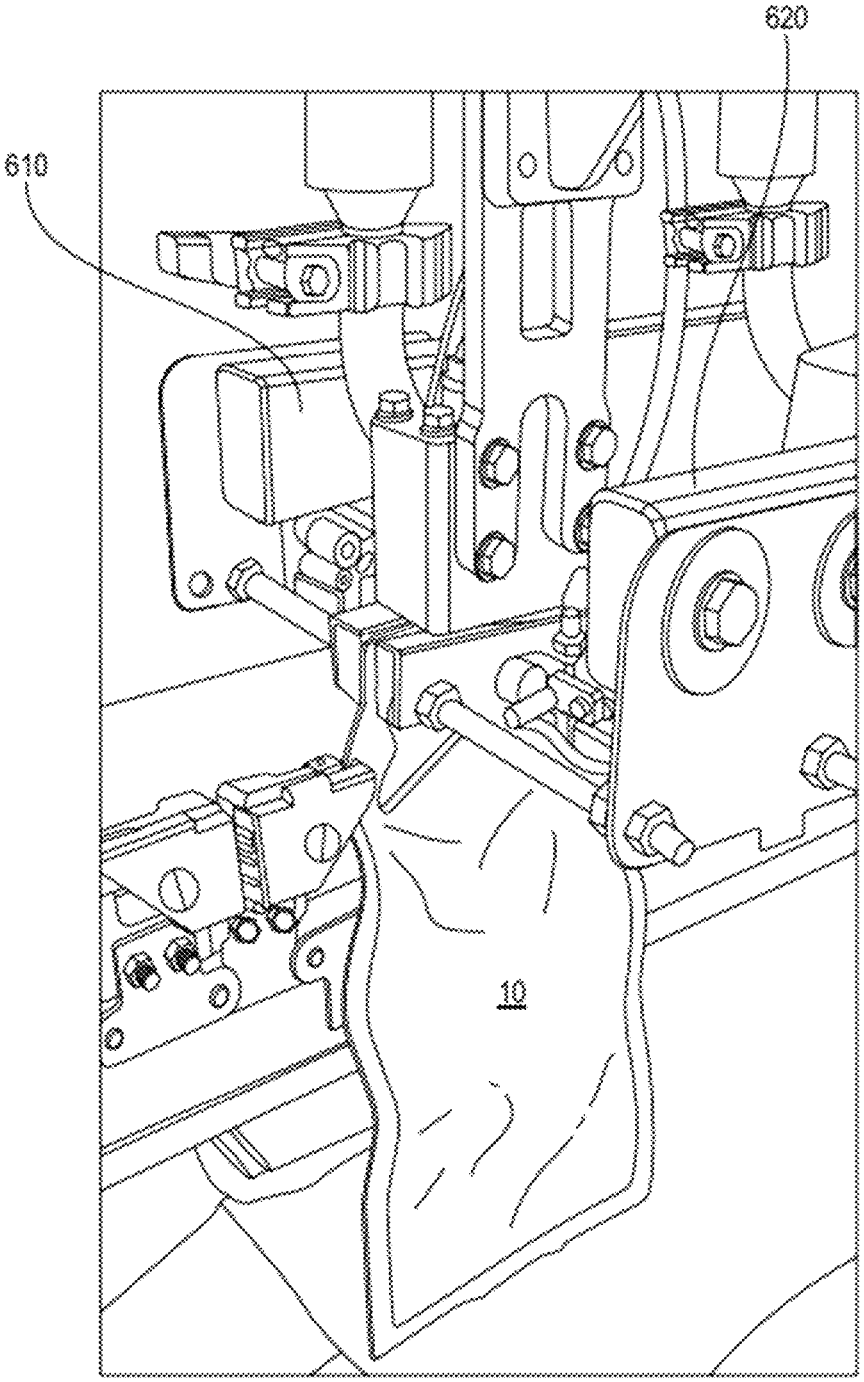
FIG. 11 is a view of a system and a method step in accordance with example embodiments.

With the above elements in mind, an operation of filling a stand-up pouch 10 is described. As shown in FIG. 7, a stand-up pouch 10 may be placed into a stand-up pouch clamp conveyor 400 and held in place by a pair of clamps 410. The clamps 410 may be attached to a chain 420 which moves the clamps 420 from one location to another. The stand-up pouch conveyor 400 may move the stand-up pouch 10 towards an assembly comprised of the pouch fill injector 100, the seal jaw assembly 200, and the stand-up pouch opening device 300 as shown in FIG. 8 allowing a top 12 of the stand-up pouch 10 to be substantially below the pouch fill spout 130 as shown in FIG. 9. When the pouch fill spout 130 is substantially aligned with a top 12 of the stand-up pouch 10 the moveable carriages 610 and 620 may move towards each other and the actuators 330 and 340 may extend so the suction cups 310 and 320 are placed against the sides 16 and 18 of the stand-up pouch 10. The actuators 330 and 340 may then retract causing the top 12 of the stand-up pouch 10 to open as shown in FIG. 10. It is understood a substantial portion of the stand-up pouch 10 remains in a flat/collapsed condition and only a small portion of the stand-up pouch 10 is opened. Thereafter, the pouch fill spout 130 is moved downwards and into the open top 12 of the stand-up pouch 10 as shown in FIG. 11. Once inserted into the open top 12 of the stand-up pouch 10 the carriages 610 and 620 are moved towards one another so that top 12 of the stand-up pouch 10 is sandwiched between the first and second jaws 210 and 220 of the seal jaw assembly 200 and the pouch fill spout 130. In particular, when the first and second jaws 210 and 220 are brought together the pouch fill spout 130 resides in the space created by the receiving areas 212 and 222 and the rest of the top 12 of the stand-up pouch 10 is sandwiched between the surfaces 214 and 224 of the first and second jaws 210 and 220. Afterwards, liquid, for example, juice, water, or ketchup, is injected into the stand-up pouch 10 via the pouch fill spout 130 while the stand-up pouch 10 is still primarily in a collapsed condition and while the top 12 is clamped by the first and second jaws 210 and 220. After the stand-up pouch 10 is filled, suction cups 310 and 320 may be detached from sides of the stand-up pouch 10, the carriages 610 and 620 may move apart from one another to cause first and second jaws 210 and 220 to move away from each other to unclamp the stand-up pouch 10, and the carriage 500 may move upwards causing the pouch fill spout 130 to be withdrawn from the stand-up pouch 10. Thereafter, the stand-up pouch 10 may be transferred to another location where a fitment may be installed in the stand-up pouch 10. Owing to the stand-up pouch 10 being clamped by the first and second jaws 210 and 220 during filling and to the fact the stand-up pouch 10 is substantially collapsed immediately prior to filling, little to no venting of the stand-up pouch 10 is required and very little to no leakage occurs from the stand-up pouch 10. Contamination of the stand-up pouch 10 is minimized, if not eliminated due to the fact air blasts are not required to open the stand-up pouch 10. Finally, in at least one nonlimiting example embodiment, liquid is introduced directly into a stand-up pouch 10 via a pouch fill spout 130 rather than an intermediary structure, for example, a fitment. This allows for flexibility not present in existing systems since the pouch fill spout 130 is generally compatible with a wide array of stand-up pouches 10.

In example embodiments the carriages 500, 610, and 620 may be moved allowing the pouch fill injector 100, the seal jaw assembly 200, and the stand-up pouch opening device 300 to also move. Movement of the pouch fill injector 100, the seal jaw assembly 200, and the stand-up pouch opening device 300 may be synchronized to a movement of a stand-up pouch 10 moving in the conveyor system 400. This means the stand-up pouch 10 may be filled while it is in continuous motion by the chain 420 allowing for a continuous filling of stand-up pouches 10.

Figure 12:
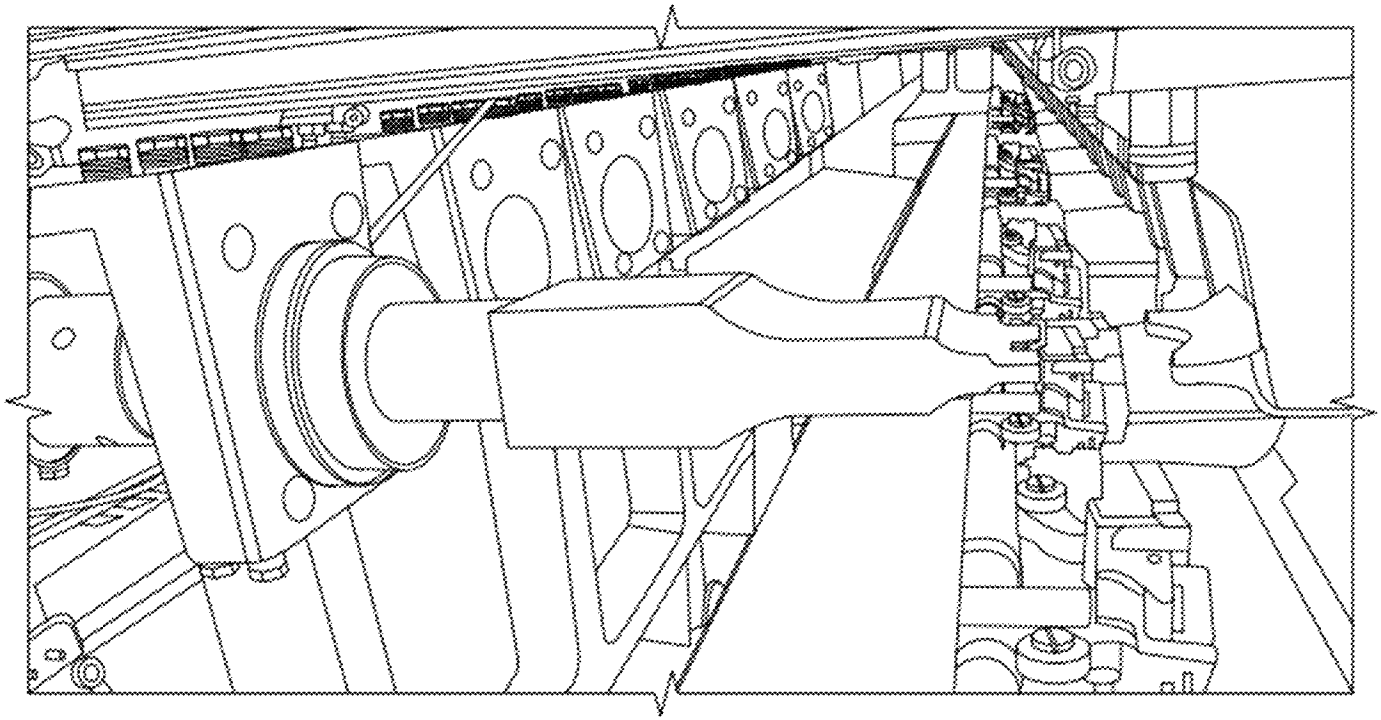
FIG. 12 is a view of fitment clamping jaws in accordance with example embodiments in a first location.
Figure 13:
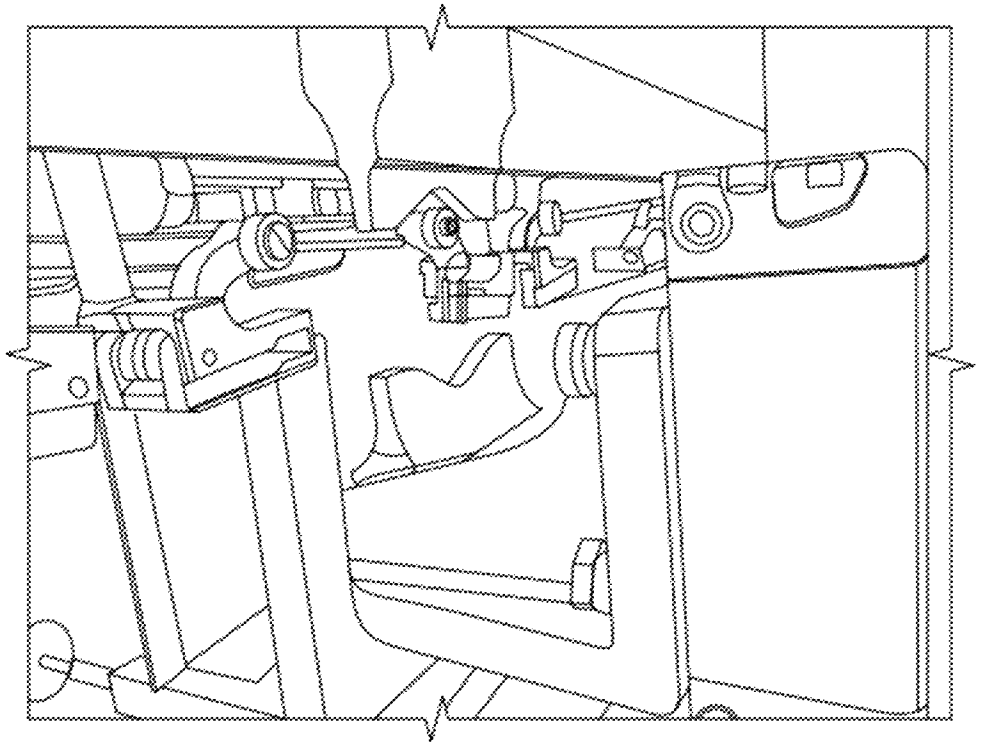
FIG. 13 is a view of a fitment clamping jaw in a second location.
Figure 14:
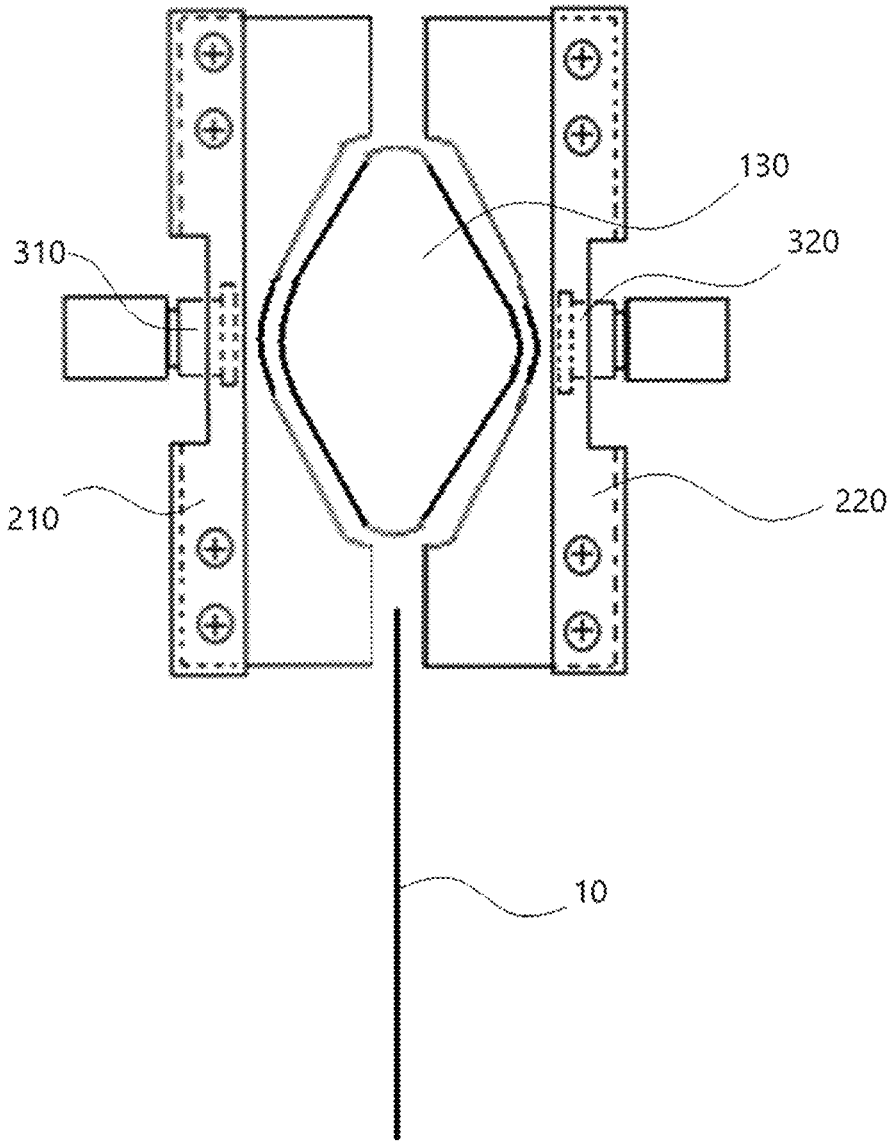
FIG. 14 is a partial view of a system in accordance with example embodiments.

The inventive features disclosed thus far are usable with additional inventive features. For example, FIGS. 12 and 13 show jaws usable for applying temperature and pressure to a fitment after the fitment is inserted into a pouch. In this particular nonlimiting example embodiment, once a fitment is inserted into a pouch the pouch is clamped by the jaws and a heat stake located in the center of the jaws moves forward and applies pressure to the outside of the pouch forming a temporary tack seal between the pouch and the fitment. The jaws retract and the pouch with fitment continue their movement into a final sealing section where clamps using heat and/or ultrasonics complete the liquid tight seal between the pouch and fitment.

Figure 15:
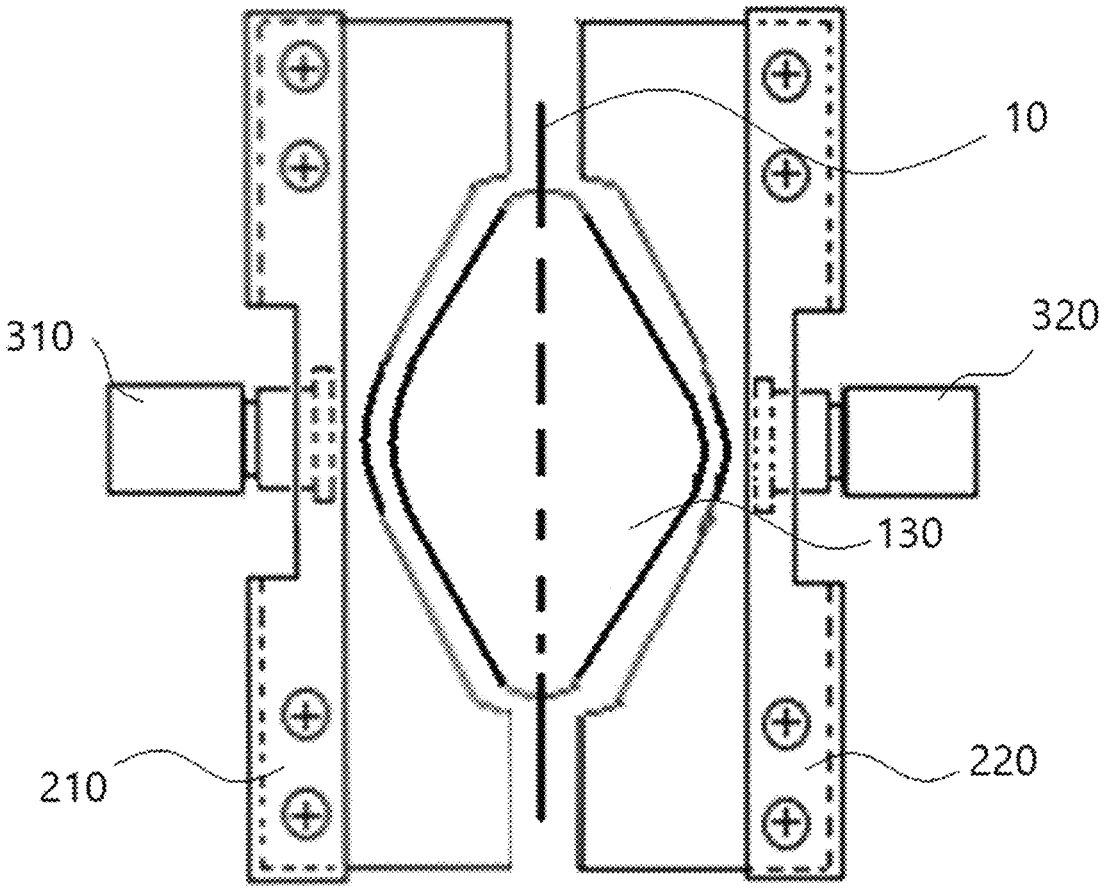
FIG. 15 is another partial view of a system in accordance with example embodiments.
Figure 16:
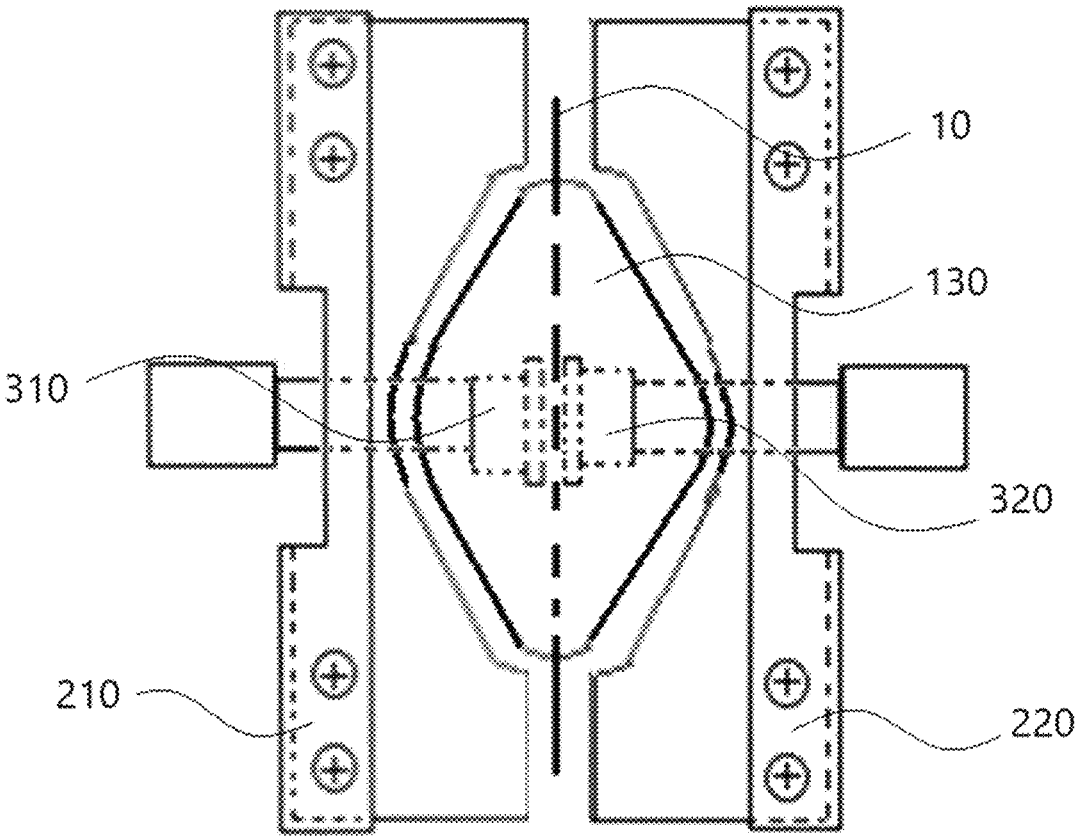
FIG. 16 is another partial view of a system in accordance with example embodiments.
Figure 17:
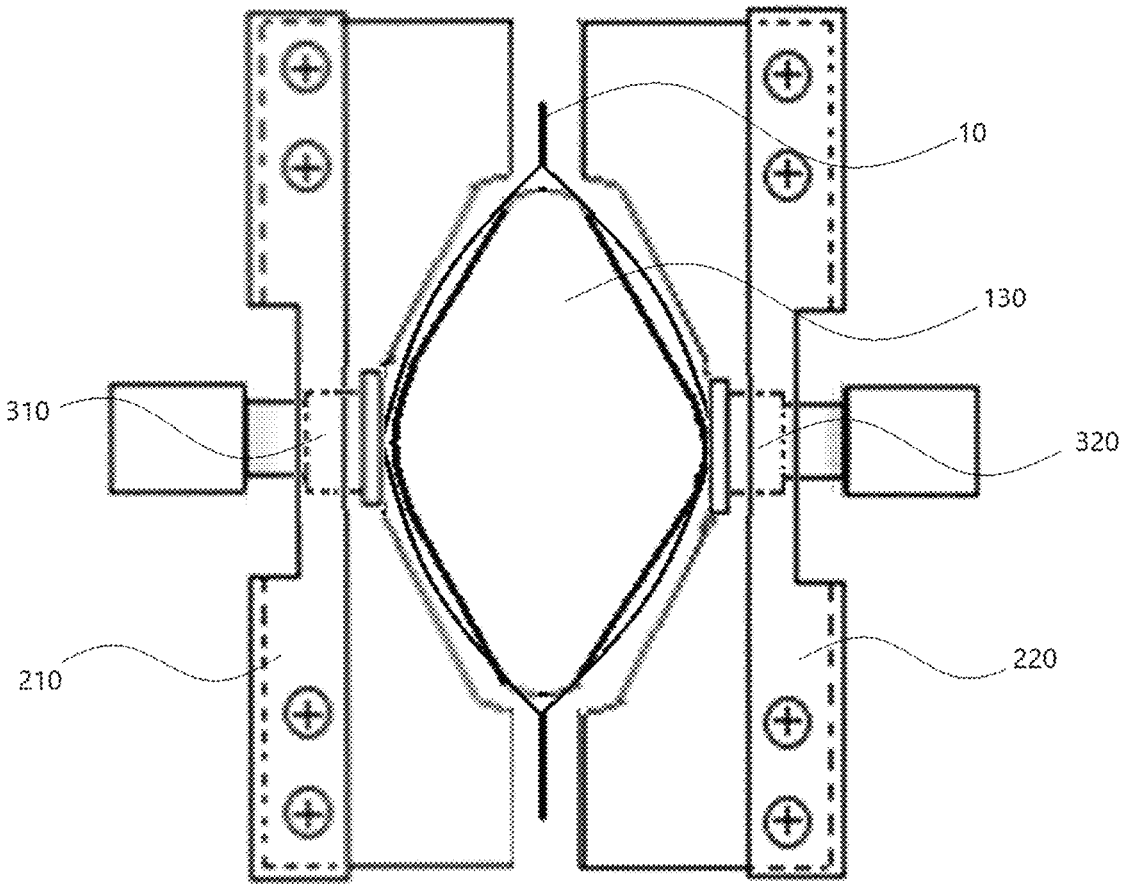
FIG. 17 is another partial view of a system in accordance with example embodiments.

FIGS. 14-18 describe a method usable with system 1000. Many of the elements of system 1000 are not shown in order to provide clarity in at least one example method. As shown in FIGS. 14-18, a stand-up pouch 10 may be moved under a pouch fill spout 130 as shown in FIG. 15 (noting the dotted line indicate a portion of the stand-up pouch 10 hidden by the pouch fill spout 130 if viewed from above the pouch fill spout 130). There after the stand-up pouch opening device 300 may be operated so that suction cups 310 and 320 are moved towards each other to attach to the sides 16 and 18 of the stand-up pouch 10 as shown in FIG. 16. The suction cups 310 and 320 may then be moved away from one another top open the stand-up pouch 10 as shown in FIG. 17. It is noted, the suction cups 310 attached near a top of the stand-up pouch 10 where the open top 12 is located. Once the stand-up pouch 10 is opened the pouch fill spout 130 may be moved downwards and into the open top 12 of the stand-up pouch 10. Once inside, the jaws 210 and 220 may be moved towards one another to clamp and seal the top of the stand-up-pouch 10. Thereafter a product, for example, water, juice, ketchup, etc. may be injected into the stand-up pouch 10 via the pouch fill spout 130.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What is claimed:

1. A method of filling a stand-up pouch, the method comprising:

securing a stand-up pouch in a clamp conveyor;

moving the stand-up pouch to a system having a fill spout, a seal jaw assembly, and a pouch opening device;

opening a top end of the stand-up pouch using the pouch opening device;

inserting the fill spout into the stand-up pouch, wherein the fill spout is inserted into the stand-up pouch when the stand-up pouch is in substantially flat unopened condition;

clamping the top end of the stand-up pouch to the fill spout using the seal jaw assembly;

filling the stand-up pouch;

unclamping the stand-up pouch;

withdrawing the fill spout;

inserting a fitment into the stand-up pouch after the fill spout is withdrawn from the stand-up pouch.

2. The method of claim 1, wherein the fill spout is movable, the seal jaw assembly is movable, and the pouch opening device is movable.

3. The method of claim 1, wherein a top end of the stand-up pouch is opened while the stand-up pouch is in motion.

4. The method of claim 3, wherein the fill spout is inserted into top of the stand-up pouch while the stand-up pouch is in motion.

5. The method of claim 1, wherein the seal jaw assembly clamps the fill spout so that as the stand-up pouch is filled air is not vented from the stand-up pouch.

6. The method of claim 1, further comprising:

passing an item through the pouch fill spout.

7. The method of claim 6, wherein the item is liquid.

8. The method of claim 6, wherein the liquid is juice.

9. The method of claim 6, wherein the item is a solid.

10. The method of claim 9, wherein the solid is at least one of food and medication.

11. A method of filling a stand-up pouch, the method comprising:

moving a stand-up pouch to a system having a pouch fill spout, a seal jaw assembly, and a pouch opening device;

opening a top end of the stand-up pouch using the pouch opening device;

inserting the pouch fill spout into the stand-up pouch while the stand-up pouch is in a substantially unopened condition;

clamping the top end of the stand-up pouch to the pouch fill spout using the seal jaw assembly;

filling the stand-up pouch with a product while the pouch fill spout is inserted into the stand-up pouch;

unclamping the stand-up pouch;

withdrawing the pouch fill spout; and inserting a fitment into the stand-up pouch after the pouch fill spout is withdrawn from the stand-up pouch.

12. The method of claim 11, wherein the product is liquid.

13. The method of claim 12, wherein the stand-up pouch is in a substantially flat state while initially is being filled with the product.

14. The method of claim 11, wherein the liquid is juice.

15. The method of claim 11, wherein the product is at least one of food and medication.

16. A method of filling a stand-up pouch, the method comprising:

receiving the stand-up pouch;

opening an end of the stand-up pouch while keeping the stand-up pouch in a substantially collapsed condition;

clamping the opened end of the stand-up pouch;

filling the stand-up, wherein filling the stand-up pouch inflates the stand-up pouch without venting air from the stand-up pouch.

17. The method of claim 16, wherein filling the stand-up pouch includes filling the stand-up pouch with a liquid.

18. The method of claim 17, wherein the liquid is a juice.

19. The method of claim 17, wherein a fill spout is inserted into the end of the stand-up pouch prior to filling the stand-up pouch.

20. The method of claim 17, wherein clamping the unopened end of the stand-up pouch prevents air from leaving the stand-up pouch during filling.

* * * * *